United States Patent [19]

Morrish et al.

[11] Patent Number: 4,878,276

[45] Date of Patent: Nov. 7, 1989

[54] SPRING CLIP

[75] Inventors: Peter G. A. Morrish, 16 Plantagenet Road, Barnet, Hertfordshire; William B. Edwards, Radlett, both of England

[73] Assignees: Peter G. A. Morrish, United Kingdom; Priscilla D. Morrish, United Kingdom

[21] Appl. No.: 207,245

[22] Filed: Jun. 16, 1988

[30] Foreign Application Priority Data

Jun. 25, 1987 [GB] United Kingdom ..... 87 14862
Sep. 25, 1987 [GB] United Kingdom ..... 87 22720

[51] Int. Cl.[4] ..... A44B 21/00; A41D 27/22

[52] U.S. Cl. ..... 24/511; 24/530; 223/91; 223/96

[58] Field of Search ..... 24/511, 498, 503, 504, 24/501, 530; 223/91, 96

[56] References Cited

U.S. PATENT DOCUMENTS

| | | | |
|---|---|---|---|
| D. 264,662 | 6/1982 | Bisk et al. . | |
| D. 265,156 | 6/1982 | Bisk et al. . | |
| 1,162,578 | 11/1915 | DeForge | 24/530 |
| 1,474,102 | 11/1923 | Ashmore | 24/511 |
| 3,239,902 | 3/1966 | Cohen | 223/91 |
| 3,456,262 | 7/1969 | Coon | 24/511 |
| 4,009,807 | 3/1977 | Coon | 223/96 |
| 4,335,838 | 6/1982 | Bisk et al. . | |
| 4,382,531 | 5/1983 | Bisk et al. . | |
| 4,446,996 | 5/1984 | Garrison | 223/96 |
| 4,562,618 | 1/1986 | Masuda | 24/511 |
| 4,658,996 | 4/1987 | Warmath | 24/511 |
| 4,660,750 | 4/1987 | Blanchard | 223/91 |

FOREIGN PATENT DOCUMENTS

| | | | |
|---|---|---|---|
| 0143506 | 9/1950 | Australia | 24/511 |
| 4084278 | 12/1982 | Australia . | |
| 0162821 | 4/1958 | Sweden | 24/501 |
| 0352309 | 4/1961 | Switzerland | 24/511 |
| 697866 | 9/1953 | United Kingdom . | |

*Primary Examiner*—Victor N. Sakran
*Attorney, Agent, or Firm*—Stevens, Davis, Miller & Mosher

[57] ABSTRACT

A spring clip, particularly for use as a peg for suspending clothes from a crossbar of a hanger, has a bar-engagement clip lying between a fulcrum for pivoting movement of a pair of levers and a nip formed by one end of the pair of levers. A U-shaped spring urging those ends together has arms the outer surfaces of which lie flush with outer surfaces of the levers to form substantially flat side surfaces. The clip is integral with the spring. The ends of the arms of the spring may engage the levers by a snap-fit. The flat side surfaces may be used for the adhesive attachment of alternative mounting means for the clip, such as a double-sided adhesive pad.

10 Claims, 4 Drawing Sheets

SPRING CLIP

PRIOR ART STATEMENT

U.S. Pat. No. 4335838 (and U.S. Pat. No. 4382531 and U.S. Des. Nos. 264662 and 265156) show an all-plastics spring clip wherein the fulcrum is defined by a bar engaged by the clip.

U.K. Pat. No. 697866 shows a clothes peg with a u-shaped metal spring fitted through windows in the levers of the clip to hold them together about a pivot point defined by the levers and to urge the levers together at one end to form a nip there.

Australian Pat. No. 40842/78 shows an all-plastics clothes peg engaged with and pivoted on a non-round bar of a hanger, and wherein a slight movement of the pivot point of at least one of the levers is permitted by displacement relative to the bar.

FIELD OF THE INVENTION

This invention relates to a spring clip, particularly though not exclusively for suspending clothes (e.g. trousers and skirts) for display or storage.

BACKGROUND OF THE INVENTION

Such clips are well known but generally have the disadvantage of being supplied as separate components requiring to be assembled on the hanger (US-A-4335838, AU-B-40842/78); and/or the disadvantage that when two spaced clips support an item of clothing they slide towards each other along the cross bar, pulled along by the weight supported; and/or the disadvantage that placing an item in a clip can be tedious.

SUMMARY OF THE INVENTION

The object of the invention is to provide a spring clip which in at least some of its forms avoids at least some of these disadvantages, and incidentally to provide a clip which in some of its forms is generally novel and preferable without necessarily meeting any of the above disadvantages.

A spring clip according to a first aspect of the invention has a pair of levers, a spring, and bar engagement means; the levers having a pair of opposite jaws in their lower end region and a pair of laterally spaced finger grips in their upper end region; the arrangement of levers and spring being such that the jaws are urged towards each other by the force of the spring to form a nip and can be separated by displacement of the finger grips towards each other against the force of the spring by application of finger pressure, articulating the levers about a fulcrum; the engagement means being disposed between the fulcrum and the nip. This enables the arrangement to be such that on separation of the jaws a bar can pass through the nip, and that the engagement means can be in gripping engagement with the bar even when the jaws are separated. The terms upper, lower, and related words, refer to the clip in its vertical position, as when suspending clothes from its jaws.

The entirety of the clip may be of synthetic plastics material, as is now common; however, it may be a single monolithic plastics moulding, with the levers, spring and engagement means integral. This is rendered possible because the components need not be assembled to the bar in situ.

The arrangement may be such that the force of the grip is independent of the separation of the jaws or the extent of separation.

Preferably the engagement means is an inner resilient spring clip (herein for convenience mostly referred to as a springlet) adapted to be snapped onto the bar to engage it. Preferably the springlet depends centrally from the spring and has a downward opening. Preferably it is integral with the spring. It may be shaped to conform to a bar of non-circular section, e.g. oval with major axis vertical, or e.g. to engage readily with a T-section bar. The springlet may have inturned projections near its opening encroaching on the embrace. With appropriate proportions of springlet and bar, engagement is a friction fit enabling the clip to be pushed along the bar but inhibiting undesired sliding movement.

However, the arrangement may be such that separation of the jaws causes gripping engagement by the engagement means or tightens the grip on the bar.

Thus, the arrangement may be such that on opening of the jaws, the springlet is displaced with respect to the levers and e.g. is itself compressed by surfaces of the levers abutting against it; or e.g. The grip of the springlet on the bar is tightened by surfaces of the levers abutting against the bar. The levers may have opposite cam shaped shoulders co-operating to form a rolling vertically moving fulcrum, and such vertical movement may cause the displacement or compression of the springlet referred to above. The shoulders may have serrations interengaging during rolling movement. Preferably the cam faces are convex upwardly, to raise the fulcrum as the jaws are separated. The feature of cam shaped shoulders is equally appropriate whether or not opening of the jaws affects the grip.

Or, as an alternative, the engagement means may take the form of overlapping hook members extending from the spring arms, the hook members being adapted to engage the bar; as the spring arms are separated upon separation of the jaws, the overlapping parts of the hook members engage the bar or tighten their grip on the bar.

The spring may be of the shape of an inverted U with its arms extending towards the jaws and the levers may have central slots to receive the arms, the proportions being such that the outer surfaces of levers and spring arms are substantially flush; this not only makes for cleanliness of appearance but also lessens the risk to delicate fabrics. It also allows a different mode of use of the clip; with a double-sided adhesive pad mounted on the flat face and adhered to a support surface such as a wall. Also, the ends of the spring arms may extend to the region of the jaws and be in positive latching engagement with the levers in the region of the jaws; hence the force of the spring is applied where it is most effective for its intended purpose.

According to a second aspect the invention provides a spring clip which has a pair of levers, a spring, and bar engagement means; the levers having a pair of opposite jaws in their lower end region and a pair of laterally spaced finger grips in their upper end region; the arrangement of levers and spring being such that the jaws are urged towards each other by the force of the spring to form a nip and can be separated by displacement of the finger grips towards each other against the force of the spring by application of finger pressure articulating the levers about a fulcrum; the levers having central slots and the spring being of the shape of an inverted U with its arms extending through the slots and towards the jaws, the spring arms being a positively locking, e.g. a snap-fitting, interengagement with the levers. Thus, when after use, a clip is released, e.g. having been held wide open for a long time (such as after suspending trousers made of thick material), its components do not fall apart even if the spring has relaxed and no longer operates to close the nip fully, because the interlock renders the levers captive with the spring. Such temporary relaxation of the spring is often referred to as "creep". Preferably the locking interengagement includes an undercut finger lodging behind a protrusion thus resisting relative movement between spring and lever. Preferably the interlock is in the end region of the spring arms. And preferably the interlock is spaced from the ends of the arms. The ends of the arms may extend to the jaws of the levers.

According to a third aspect the invention provides a spring clip which has a pair of levers and a spring; the levers having a pair of opposite jaws in their lower end region and a pair of laterally spaced finger grips in their upper end region; the arrangement of levers and spring being such that the jaws are urged towards each other by the force of the spring to form a nip and can be separated by displacement of the finger grips towards each other against the force of the spring by application of finger pressure, articulating the levers about a fulcrum; the levers having longitudinal central slots and the spring being of the shape of an inverted U with its arms extending through the slots and towards the jaws, each lever having a pair of shoulders flanking its slot, such that when the levers are aligned the shoulders form opposite surfaces co-operating to form the fulcrum. Preferably the shoulders are cam shaped. Preferably they are so arranged as to form a moving fulcrum. Preferably the slots extend along the levers at least a quarter of the distance between nip and fulcrum, preferably at least a third; and the slots may extend along the major part or nearly the whole of the lever remote from the nip. The combination of long slots and fulcrum formed by flanking opposed shoulders enables great economy of material to be achieved, which is a major factor in the cost of plastics mouldings.

According to a fourth aspect the invention provides in combination a hanger bar and a spring clip having jaws forming a nip, the hanger bar being of non-circular cross section, and the clip having bar engagement means with a non-circular embrace for the bar, the relative proportions of bar and engagement means being such that the clip is restrained from turning on the bar and that the clip can slide along the bar. Thus, the clip retains its orientation on the bar (for most purposes the required orientation will be upright), and any further clips placed on the same bar will tend to the same orientation. Preferably the proportions are such that the engagement means engages the bar with a friction fit; thus the clip can slide along the bar when pushed in the appropriate direction but unwanted sliding movement is inhibited. Preferably the cross section of the bar and the embrace of the engagement means conform. Preferably both are oval with the major axis upright. The engagement means may of course have one or more of the attributes mentioned earlier in this text in relation to the springlet. The bar can form part of a coat hanger or can be open ended or can e.g. constitute the rail of a display stand (such as a rail in the nature of a hoop).

The features of the several aspects of the invention described above may of course be used in combination whenever appropriate.

If the clip is a monolithic moulding, the part of it constituting the spring is preferably of upright U-shape with its arms extending towards the finger grips.

Two forms of spring clip embodying the invention, and two modifications, will now be described by way of example with reference to the accompanying drawings in which:

DESCRIPTION OF PARTICULAR EMBODIMENTS

Figure 1:
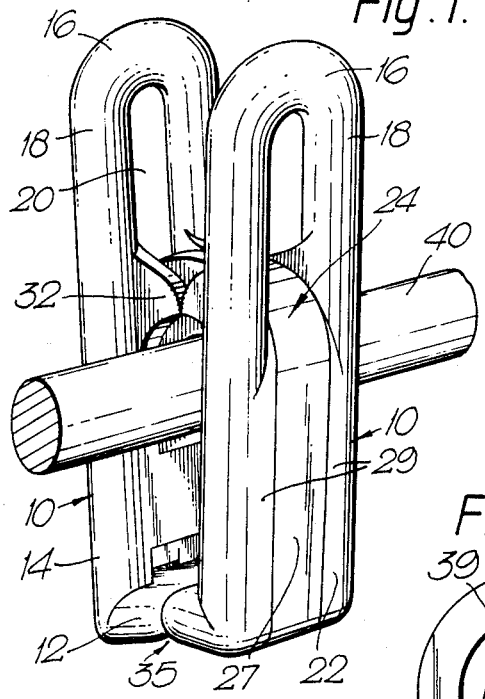
FIG. 1 shows a first form of spring clip in perspective.
Figure 2A:
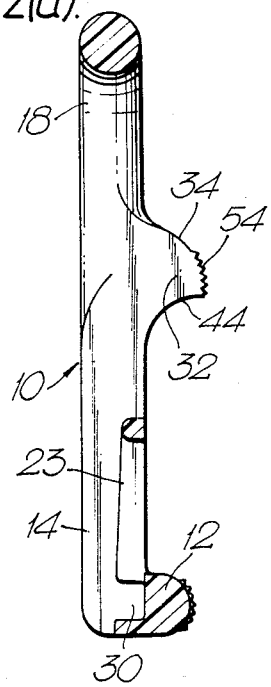
FIG. 2(*a*) is a side elevation of a lever forming part of the clip, shown partly in section, and FIG. 2(*b*) is a corresponding end view.
Figure 3A:
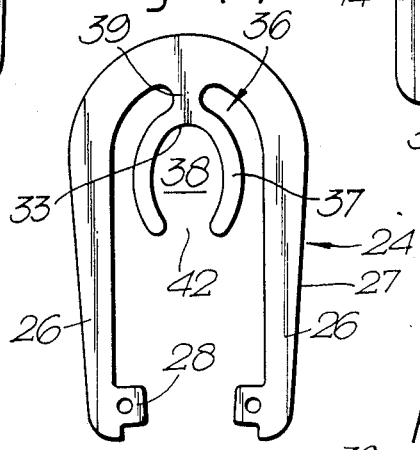
FIG. 3(*a*) is a side elevation of the spring forming part of the clip, and FIG. 3(*b*) shows the spring in perspective.
Figure 2B:
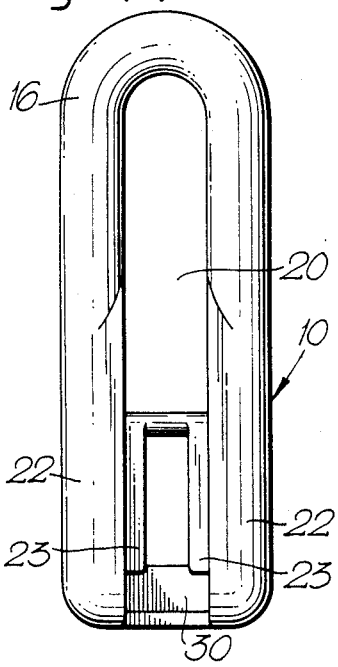
Figure 3B:
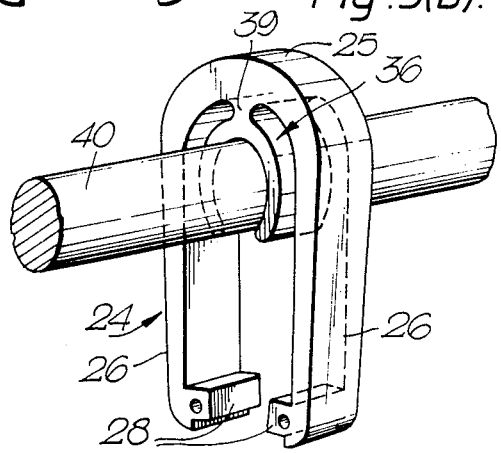
Figure 4A:
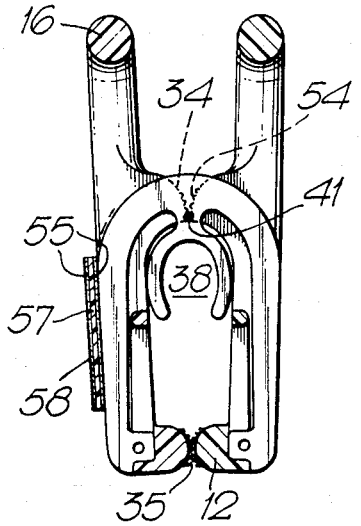
FIGS. 4(*a*) and 4(*b*) illustrate (to a reduced scale) locking of the clip onto a bar when the jaws of the clip are separated.
Figure 4B:
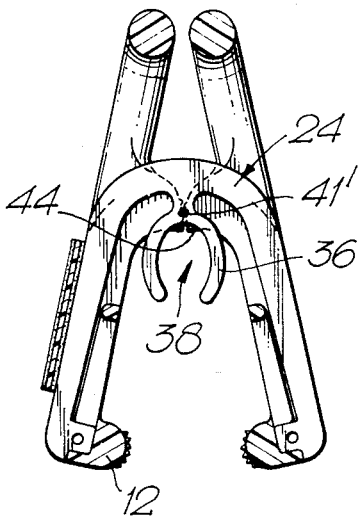

Turning to FIGS. 1 to 5, a spring clip embodying the invention has a pair of identical levers 10, with opposed jaws 12 in their lower end region 14 and finger grips 16 in their upper end region 18 laterally spaced apart (as best seen in FIGS. 1 and 4). Each level has a longitudinal central slot 20 leaving side parts 22 flanking the slot and recessed outwardly inclined ramps 23 in downward continuation of the slot.

An inverted U-shaped spring 24 passes through the two slots 20. It has a base 25 and two arms 26. The arms 26 extend in substantially the same direction as the levers, towards the jaws, and the free ends of the arms have projections 28 which fit in corresponding recesses 30 formed in the levers behind the jaws 12. The outer surfaces 29 of the side parts 22 of the levers are substantially flat and so are the outer surfaces 27 of the arms 26 of the spring, and they are so proportioned that those outer surfaces 27,29 are substantially flush in the sense of forming a single almost flat surface as the side surface of the clip (as best seen in FIG. 1).

The levers also have pairs of spaced opposite lugs 32 in the region where the spring passes through the slots (one lug of each pair being on either side of the slots 20) and each lug has a cam surface 34 as shown.

The spring holds the levers together in juxtaposition, with the jaws pressed together to form a nip at 35 and with the pairs of lugs held to each other. As finger pressure brings the finger grips 16 together, the opposed cam surfaces roll against each other constituting a moving fulcrum 41 articulating the levers (see FIG. 4), and the jaws 12 are separated against the spring force acting behind the jaws.

Figure 5A:
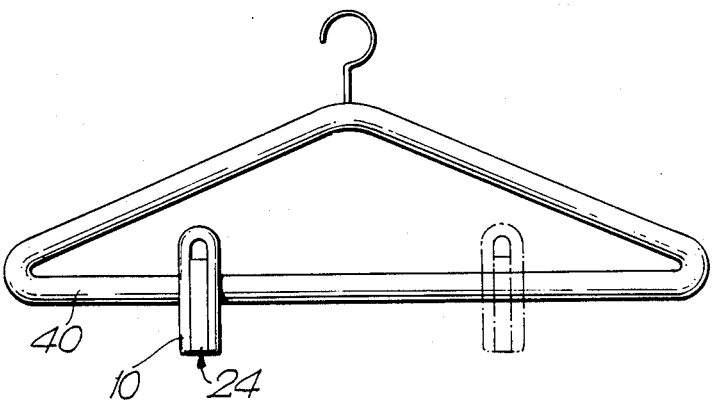
FIGS. 5(*a*) and 5(*b*) respectively show a clip fitted to the bar of a coat hanger and the cross section of the hanger bar.
Figure 5B:
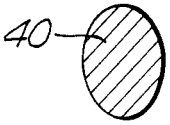

Centrally depending from the bight of the spring 24 is a springlet 36, being an inner resilient spring clip constituting bar engagement means. The springlet has a closed base 33 and incurved limbs 37 forming an embrace 38. It is formed integrally with the spring and is centrally and symmetrically connected to it by a web 39. The clip is intended for use with a hanger having a cross bar 40 of non-circular, e.g. oval, section as shown in FIGS. 1, 3(*b*) and 5(*b*). So, the springlet is likewise generally oval as seen in side view (with its major axis vertical like the hanger bar), its embrace substantially conforms to the cross section of the bar, its downward opening mouth 42 is narrower than its inner width, and the latter is fractionally narrower than the width of the hanger bar 40. In the result, the clip can be fitted to the hanger bar upon opening of the jaws and snapping the springlet onto the bar, which it engages with a friction fit. If the dimensions are appropriate a clip could be fitted onto a free-ended bar by that free end being passed into the gap between the jaw portions (the nip being closed) and the clip then being pushed down onto the bar so that the springlet engages it. Because of the grip of the springlet on the bar the clip does not slide along the bar unintended but can be slid by pushing it along and it is held in a desired orientation on the bar. Trial has shown that an oval section springlet can also engage satisfactorily with a T-section bar. As shown in FIG. 5(*a*) a hanger would normally be fitted with two clips (in a drawing, one is indicated in broken line).

To hang clothes from the clip the jaws are again opened, but with the clip retained on the bar by reason of engagement with the springlet. As the opposed cam surfaces 34 roll against each other, the fulcrum rises relative to the nip to the position 41' (FIG. 4(*b*)) and the free ends 44 of the cams 32 are displaced downwards relative to the spring and springlet. The relative proportions may be such that there is an interference fit (shown greatly exaggerated for ease of illustration) between the lug ends 44 and the embrace 38 of the springlet and consequently the grip with the bar is tightened, locking the clip in position. This locking can be further assured by laterally ribbing at least the top of the bar 40.

In the absence of such interference fit, e.g. by use of different proportions of the respective parts, the grip exerted by the springlet on the bar would be substantially constant, both when the jaws are closed and when open, which may well suffice to prevent undesired sliding of the clip along the bar for most purposes.

The movement of the fulcrum from e.g. position 41 to position 41' maintains that fulcrum substantially stationary relative to the base of the spring 24 and of the springlet 36 to both of which its line of action is closely adjacent.

The components of the clip are manufactured from conventional plastics materials by conventional injection moulding techniques. They are assembled by placing a pair of levers 10 in juxtaposition and slipping an arm 26 of a spring 24 through the opposite slots 20 of the levers. On pressing the spring downwardly, its converging arms 26 are flexed in the outward direction, and its projections 28 slide downwardly until they enter the recesses 30 in the levers with the spring remaining slightly converging (as best seen in FIG. 4(*a*)) but still flexed to press the jaws together. Ramps 23 support the arms 26 of the spring. It is obvious that there is no need for a bar 40 to be present during that asembly; indeed it is preferable that it should not be.

Figure 6A:
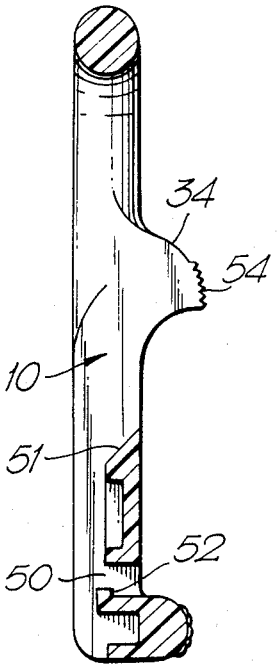
FIGS. 6(*a*), 6(*b*) and 6(*c*) are side elevations of a modified form of lever, spring and the assembly thereof respectively.
Figure 6B:
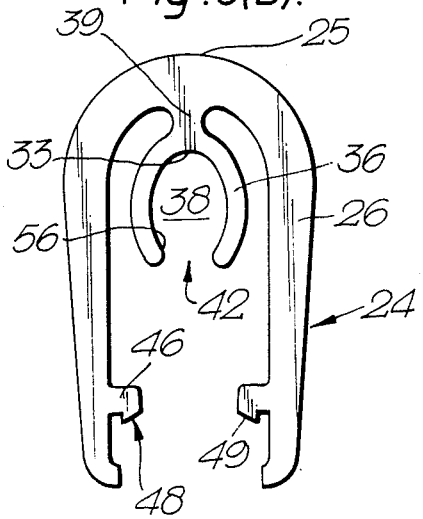
Figure 6C:
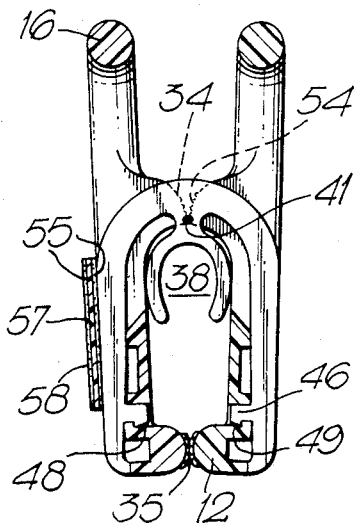

The modified spring clip of FIGS. 6(*a*), (*b*) and (*c*), which is the presently preferred embodiment, has the arms 26 of its U-shaped spring 24 in interlocking engagement with the levers 10 near the end regions of the levers. A finger 46 in the end region of the spring arm but spaced from its end, is undercut to form a hook 48. Likewise spaced from the end of the lever is a recess 50 formed with a protrusion 52, such as a rib or pip(s). The arrangement and proportions are such that on assembly, the finger is received and latched in the recess and the hook locks behind the protrusion with snap action. Hence, the levers remain captive with the spring even while the latter (as a result of relaxation) temporarily fails to close the nip fully. However, the ends of the spring arms extend to the ends of the levers, again making for a substantially smooth flush side surface. The leading edge 49 of the hook is inclined and the lever has a correspondingly inclined ramp 51 disposed near the lower end of the slot, the edge of the hook sliding over the ramp during assembly, flexing the spring outwardly. In this embodiment the angle of inclination is 45°. The cam surfaces 34 are serrated as shown at 54; as the cams roll against each other, the serrations engage in the manner of gear teeth and help maintain the levers in vertical alignment. And the springlet 36 has inturned projections 56 near its opening 42 which encroach slightly on its embrace 38; this improves the friction fit between springlet and hanger bar and helps compensate for tolerances, and also enables the springlet readily to grip bars of circular cross section of a range of different diameters.

Figure 7:
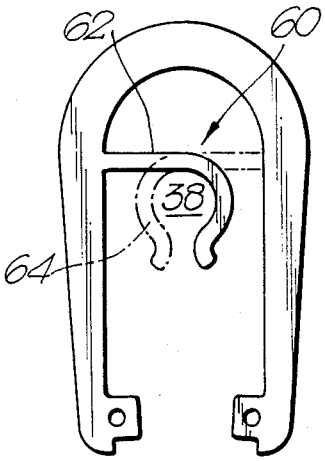
FIG. 7 shows a modified form of spring for the clip of FIGS. 1 to 4; and, FIGS. 8(*a*) and 8(*b*) show a second form of preferred spring clip in perspective and end view respectively, the clip being a monolithic moulding.

Turning to FIG. 7, the spring there shown has hook members 60 constituting the engagement means. The hook members are formed with stalks 62 laterally extending towards each other from the spring arms 26 and with their hooks 64 overlapping to form an embrace 38. As the jaws of the clip are separated, the spring arms 26 move apart, the hooks narrow their embrace, and thereby make for engagement or tighter gripping engagement with the hanger bar 40 (depending upon the relative proportions of the parts).

Figure 8A:
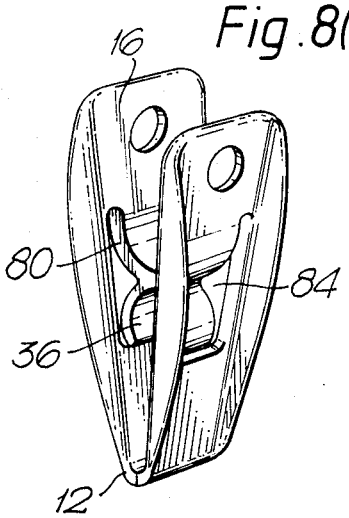
Figure 8B:
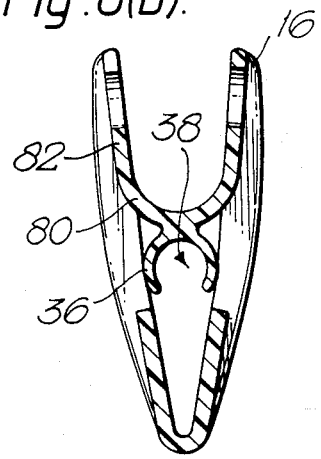

The spring clip of FIG. 8 is a monolithic moulding and its parts corresponding to those of FIGS. 1 to 4 bear corresponding reference numerals. Its spring 80 is of the shape of an upright U, and here too the springlet 36 depends from its bight. The arms 82 of spring 80 extend towards finger grips 16. Apertures 84 are formed in the levers 10 for ease of mould tool design, being at least co-extensive (seen in end view as in FIG. 8(*b*)) with the curved parts of spring and springlet where they depart from the general curvature of the levers 10. The advantage of a one piece moulding is manifest: it avoids the need for moulding several components which then have to be assembled.

In a modification of the clips of FIGS. 1 to 6 (not shown), the springlet may be omitted. Such spring clip of course does not grip any hanger bar, but its novel construction represents a preferable, desirable, form of clip, partly because of its novelty of design and appearance, its versatility and not least enabling considerable economy in material. In all the clips, there is also the feature of interchangeability of springs of different strength or length with levers of different length and both in a variety of colour combinations for ease of colour coding—useful e.g. in the display of garments of differing sizes.

Because of the flat side surface of the clip, a mounting means (FIG. 4(*a*)) may be attached to it. A layer of adhesive 55 bonds a conventional substrate layer 57 of a double-sided adhesive pad to the clip. An outer layer 58 may be a cover layer removable to reveal a second adhesive layer whereby the clip may be stuck to a surface, or may be a magnetic sheet whereby the clip may be magnetically attracted to a surface. A magnetic or other attractive layer (e.g. Velcro R) may be directly adhered to the side surface. Furthermore the flatness of the surface allows printing or labelling to be applied to that surface.

It will be appreciated that many modifications may be made to the specific forms of clip described above without departing from the scope of the invention. Thus, for example the pair of levers can be monolithic, formed with an integral hinge, to be assembled to a separate spring. The springlet can be fixed to some part of the clip other than the spring (albeit between fulcrum and nip), and its embrace in some aspects of the invention can be circular instead of oval. And of course the clip need not be wholly of plastics. Moreover it will be understood that the clip may be used not only with a coat hanger bar but also on other forms of suspender having a bar or even on a flexible cord, to suspend e.g. skirts, neck ties, paper items, or indeed any other items to be suspended from a clip e.g. for display. And, for example, the clip may be used e.g. with a bar like object such as a ball point pen held in the springlet and a pad of paper held in the nip (the plastic of the levers may be of a different colour from that of the spring, enabling pleasing colour matching effects to be achieved, e.g. with the ball point pen and paper, or with other objects held in the springlet and nip), or indeed as a general-purpose clip for use in the office or in the home e.g. for holding stationery, towels, dusters or the like.

We claim:

1. A spring clip comprising:

a pair of levers having two ends, said levers including a handle portion toward one of said ends thereof and a jaw portion toward the other of said ends, means defining a fulcrum intermediate said ends about which said levers are relatively pivotable for mutual approach or parting of said jaw portions, spring means urging said other of said ends for mutual approach to form a nip, said spring means comprising a substantially U-shaped spring member having two arms and a base joining said arms, said arms lying respectively along said jaw portions of said levers and said base bridging between the levers, said fulcrum being adjacent to said base, means for engaging said spring clip to a bar, said engagement means being intermediate said fulcrum and said nip comprising a resilient clip having a closed base and a restricted open mouth, said open mouth being disposed towards said nip, and said resilient clip being integral with said spring member.

2. A clip as claimed in claim 1 wherein said closed base of said resilient clip is adjacent said fulcrum.

3. A clip as claimed in claim 1 wherein said fulcrum defining means comprises a camming surface on each lever, said spring means urging said camming surfaces into contact, and said surfaces being adapted for rolling line contact therebetween upon said pivoting of said levers whereby to define a moving said fulcrum.

4. A clip as claimed in claim 3 wherein tooth means are provided on said camming surfaces for preventing slippage therebetween.

5. A spring clip as claimed in claim 3 wherein upon said movement of said fulcrum upon opening of said nip, said cam means move to interfere with said engagement means to tighten engagement of said clip on said bar.

6. A clip as claimed in claim 1 wherein mutually outer surfaces of said arms lie substantially flush with mutually outer surfaces of said jaw portions to define flat side faces of said spring clip.

7. In combination, a clip as claimed in claim 1 and suspension means therefor, said suspension means comprising a bar which is generally horizontal in use, said bar having a non-circular cross section and said resilient clip having a correspondingly non-circular cross section whereby to tend to maintain said spring clip in a predetermined orientation relative to the suspension means.

8. A clip as claimed in claim 1 wherein said jaw portions have end faces adjacent said nip and said arms extend flush along said side faces into said end faces and flush therewith.

9. A spring clip comprising a pair of levers having two ends, said levers including a handle portion toward one of said ends thereof and a jaw portion toward the other of said ends, said levers having means for pivotal interabutment between them for defining a fulcrum therebetween intermediate said two ends of said levers, means on said interabutment means for preventing slippage therebetween, said levers being relatively pivotable about said fulcrum for mutual approach or parting of said jaw portions, spring means urging said other of said ends for mutual approach to form a nip at ends thereof distal from said ones of said ends, said spring means comprising a substantially U-shaped member having two arms and a base joining said arms, said arms lying respectively along said jaw portions of said levers to said distal ends and said base bridging between the levers adjacent said fulcrum, said arms engaging said levers adjacent said nip by a restricted mouth forming a snapfit engagement with a portion of said jaw portions, mutually outer surfaces of said arms lying flush with mutually outer surfaces of said jaw portions to define substantially flat side faces of said spring clip.

10. A clip as claimed in claim 9 including means on one of said flat side faces for securing said clip to a flat surface.

* * * * *